US005655304A

United States Patent [19]

Apfel et al.

[11] Patent Number: 5,655,304

[45] Date of Patent: Aug. 12, 1997

[54] GUIDE BAR WITH ATTACHED WEAR PROTECTOR

[75] Inventors: Norbert Apfel, Waiblingen; Udo Bartmann, Berglen, both of Germany

[73] Assignee: Andreas Stihl, Waiblingen, Germany

[21] Appl. No.: 568,376

[22] Filed: Dec. 7, 1995

[30] Foreign Application Priority Data

Dec. 7, 1994 [DE] Germany ..... 44 43 477.4

[51] Int. Cl.[6] ..... B27B 17/02

[52] U.S. Cl. ..... 30/383; 30/387

[58] Field of Search ..... 30/381–387; 76/112

[56] References Cited

U.S. PATENT DOCUMENTS

| | | | |
|---|---|---|---|
| 3,858,321 | 1/1975 | Conaty | 30/383 |
| 3,910,709 | 10/1975 | Krekeler | 30/387 X |
| 5,144,867 | 9/1992 | Yajima et al. | 30/387 X |
| 5,471,751 | 12/1995 | Ball | 30/383 |

FOREIGN PATENT DOCUMENTS

| | | | |
|---|---|---|---|
| 706560 | 5/1941 | Germany | 30/381 |
| 1943917 | 3/1971 | Germany | 30/383 |

*Primary Examiner*—Douglas D. Watts

*Attorney, Agent, or Firm*—Robert W. Becker & Associates

[57] ABSTRACT

A guide bar for a motor chain saw has a guide bar member having a peripheral guide groove and peripheral shoulders for guiding a saw chain in the peripheral direction of the guide bar member. The drive members of the saw chain engage the guide groove and the lateral connecting members of the saw chain are guided on the shoulders. Wear protectors, made of a material that is more wear-resistant than the guide bar member, are provided. The wear protectors are connected to the peripheral shoulders so as to extend at least over a portion of the guide bar member in the peripheral direction. Each wear protector has a first wear surface facing the drive members of the saw chain and a second wear surface facing the lateral connecting members of the saw chain. At least one of the first and second wear surfaces of each wear protector has at least one peripheral recess extending in the peripheral direction.

30 Claims, 6 Drawing Sheets

GUIDE BAR WITH ATTACHED WEAR PROTECTOR

BACKGROUND OF THE INVENTION

The present invention relates to a guide bar for saw chains of a motor chain saw with an outer peripheral guide groove which is engaged by the central drive members of the saw chain, with a race formed by each shoulder of the guide groove on which the lateral connecting members connecting the drive members of the saw chain run, whereby the shoulders at least over a portion of their peripheral length are covered by an attached wear protector which is made of a material which is more wear resistant then the material of the guide bar member of the guide bar.

Such a guide bar is known from U.S. Pat. No. 3,858,321. For protecting against increased wear the reversal area of the guide bar is provided with a wear protecting portion applied to the stays of the guide groove which wear protecting parts are fixedly connected to the stays, for example, by welding or brazing The wear protecting part is comprised of a material that is more wear-resistant than the guide bar member of the guide bar. Suitable for this purpose are, for example, cobalt hard alloys (stellite).

However, in practice it has been proven that after a certain operating period the material of the wear protectors due to the load exerted thereon is plastically deformed. It has been found especially that the material of the wear protecting parts grows into the guide groove and thus makes it more narrow. This results in the saw chain moving with difficulty within the guide groove so that an increased amount of drive power is required for driving the saw chain which is thus no longer available for the cutting action of the saw chain. Under unfavorable conditions the deformation (growing) of the material of the wear protecting parts into the guide groove can result in jamming of the saw chain and thus to failure of the motor chain saw. It is therefore an object of the present invention to improve a guide bar of a saw chain of a motor chain saw such that even after prolonged operation a narrowing of the guide groove can be reliably prevented.

SUMMARY OF THE INVENTION

The guide bar for a motor chain saw according to the present invention is primarily characterized by:

A guide bar member having a peripheral guide groove and peripheral shoulders for guiding a saw chain in a peripheral direction of the guide bar, wherein drive members of the saw chain engage the guide groove and wherein lateral connecting members of the saw chain are guided on the shoulders;

Wear protectors comprised of a material that is more wear-resistant than the guide bar member, the wear protectors connected to the shoulders so as to extend at least over a portion of the guide bar member in the peripheral direction;

Each one of the wear protectors having a first wear surface facing the drive members of the saw chain and a second wear surface facing the lateral connecting members of the saw chain; and Wherein at least one of the first and second wear surfaces of each one of the wear protectors has at least on peripheral recess extending in the peripheral direction.

Advantageously, the at least one peripheral recess extends over the entire length of the wear protectors.

Preferably, across the width of one of the first and second wear surfaces of each one of the wear protectors a plurality of peripheral recesses is arranged adjacent to one another.

Expediently, neighboring ones of the peripheral recesses laterally abut one another.

In a preferred embodiment of the present invention, neighboring ones of the peripheral recesses are spaced at a distance from one another. Preferably, the peripheral recesses are spaced equidistantly from one another.

In yet another embodiment of the present invention the at least one peripheral recess extends parallel to a longitudinal edge of the wear protectors.

Advantageously, the peripheral recesses in cross-section have a contour of a circular sector or have an angular contour. Preferably the contour is triangular.

Advantageously the peripheral recess has a maximum depth and a width. The maximum depth is preferably identical to the width. However, it is also possible that the width is greater than the maximum depth.

Preferably, the peripheral recess is position centrally within in the wear surface.

In a preferred embodiment of the present invention the peripheral recess is located in the first wear surface.

Advantageously, the peripheral recess is located in the second wear surface.

In another embodiment of the present invention, the second wear surface has two longitudinal edges. At least one of the longitudinal edges is machined by a process selected from swaging, cutting, stamping and forging.

Preferably, the at least one longitudinal edge is convexly or concavely rounded. The longitudinal edge may be rounded with a constant radius or may have a curvature determined by a logarithmic function.

In another embodiment of the present invention, at least one of the longitudinal edges has a bevel. The bevel extends preferably over a portion of the width of the first wear surface and over a portion of the width of the second wear surface wherein the portion of the width of the first wear surface is greater than the portion of the width of the second wear surface.

Expediently, the wear protectors and the guide bar member are separate parts and the wear protectors are fastened to the shoulders.

The first wear surface of the wear protector has a rough surface finish. The rough surface finish is corrugated or fluted or has a grainy structure.

According to the present invention, the wear protector on its side facing the saw chain is provided with at least one recess which extends in the direction of length of the wear protector.

By providing such a recess a receiving space is provided into which the material of the wear protector can grow. It has been demonstrated that surprisingly even after extended operating periods a narrowing of the guide groove due to material deformation of the wear protector is no longer observed when the inventive measures are taken. Instead, the ductile material of the wear protector has surprisingly the tendency not to grow into the empty space of the guide groove but to fill first the constructively provided recess. With the inventive embodiment it is possible to achieve substantially increased operating periods before the material of the wear protector, due to the loads exerted thereon, is worn off and deformed to such an extent that running within the guide groove is impeded. However, at this time, the saw chain and the guide groove are worn to such an extent that new parts must be employed anyway.

The inventive recess, in a simple design, is provided by a bevel at a longitudinal edge, preferably at the inwardly (adjacent to the guide groove) oriented longitudinal edge of the wear protector. It is possible to select shapes according to the material of the wear protectors as well as to the respective load distribution, for example, in cross-section the bevel may have a triangular shape, may be rounded with a constant radius or rounded according to a logarithmic function. The rounded recesses may convexly or concavely curved.

When the longitudinal edge is beveled by swaging or forging, it is possible to achieve within the area of the recess an increase of the material hardness. This is advantageous with respect to lowering the wear at this location.

The wear protector is preferably provided with a rough surface finish at one of its sides, preferably at the wear surface which is part of the sidewall of the guide groove, for example, by providing a corrugated or fluted structure or a grainy structure. In this manner the residence time of the oil introduced into the guide groove for the purpose of lubricating the saw chain is increased. Especially at the reversing portion of the guide bar, it is thus ensured that a sufficient amount of lubricating oil is present so that wear at this location is further reduced.

BRIEF DESCRIPTION OF THE DRAWINGS

The object and advantages of the present invention will appear more clearly from the following specifications in conjunction with the accompanying drawings in which.

DESCRIPTION OF PREFERRED EMBODIMENTS

The present invention will now be described in detail with the aid of several specific embodiments utilizing FIGS. 1 through 16.

Figure 1:
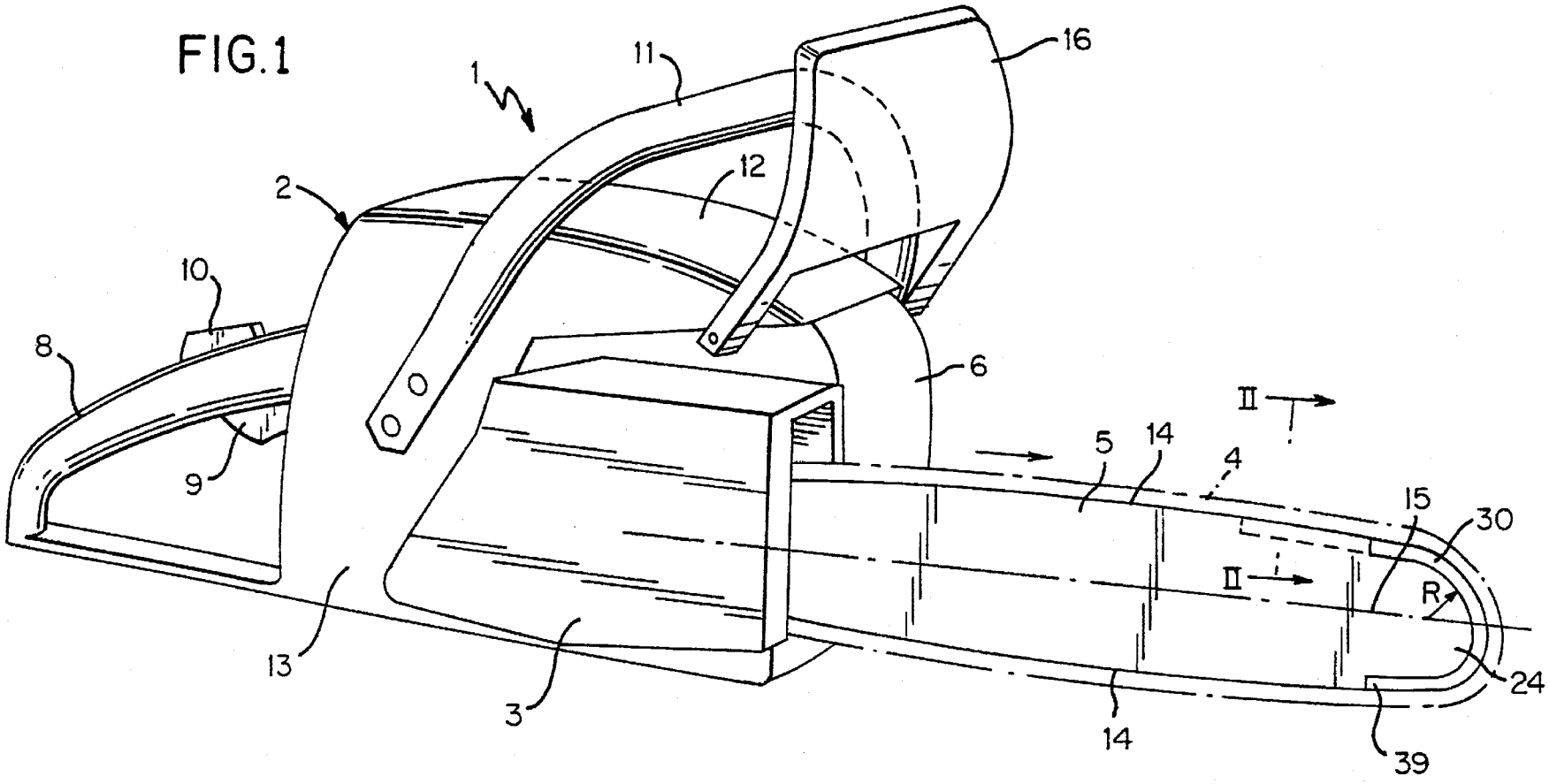
FIG. 1 is a perspective view of a motor chain saw with inventive guide bar.

The motor chain saw represented in FIG. 1 comprises a housing 2 in which the drive motor is positioned. The drive motor may be an electric motor or an internal combustion engine, especially a two-stroke engine.

Figure 2:
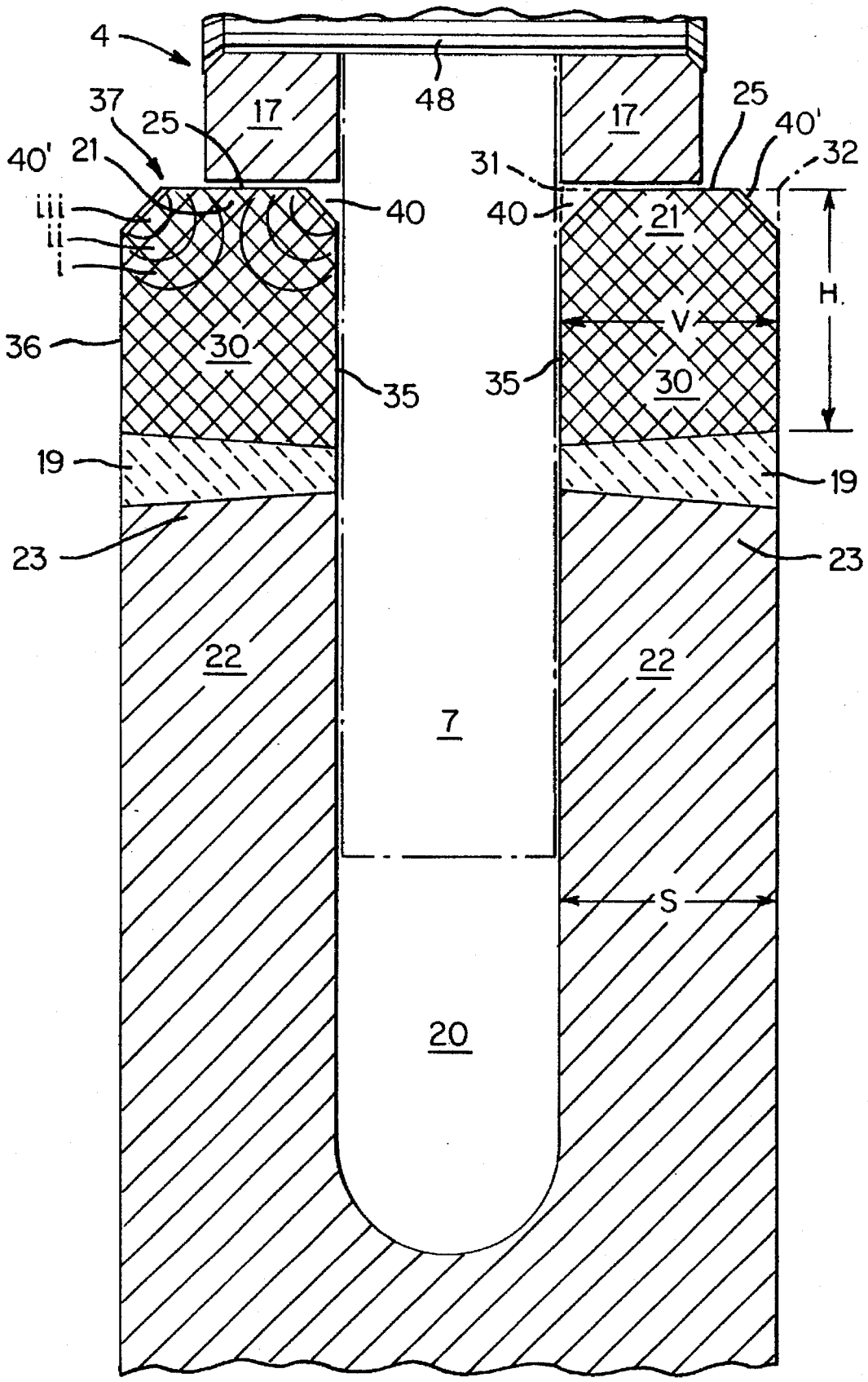
FIG. 2 is a sectional view of the guide groove at the periphery of the guide bar along line II—II of FIG. 1.

In a longitudinal direction of the housing 2 the guide bar extends from the front end 6 of the housing. The periphery of the guide bar is provided with a peripheral guide groove 20 (FIG. 2). In this guide groove 20 the saw chain 4 is guided whereby the centrally positioned drive members 7 engage the guide groove 20. The drive members 7 are connected pivotably to one another in the longitudinal direction of the saw chain 4 by lateral connecting members 17 and rivet bolts 18. The lateral connecting member 17 run on the shoulders of the stays 22 of the guide groove 20. The shoulders form the race for the lateral connecting members The saw chain 4 is driven by a non-represented sprocket wheel whereby the sprocket wheel is covered by the sprocket wheel cover 3 which is connected to the longitudinal side 13 of the housing 2. The sprocket wheel is connected to the drive shaft of the motor, preferably via a frictional coupling.

At the backside of the housing 2 opposite the front side 6, in the longitudinal direction of the motor chain saw 1, a rearward grip 8 is provided at which the throttle lever 9 as well as throttle lever lock 10 are pivotably supported. The upper side 12 of the housing 2 is bridged by a forward grip bracket 11 which is fastened to the longitudinal side 13 of the housing 2 at which the cover 3 for the sprocket wheel is provided. The grip bracket 11 extends spaced as a distance to the upper side 12 of the housing 2 and the longitudinal side 13 to the opposite longitudinal side of the housing and is connected with the other end to the bottom area of the housing 2. In front of the grip bracket 11 a protective bracket 16 is provided which, when pivoted, may activate a safety breaking device acting on the sprocket wheel.

The guide groove 20 extending about the periphery of the guide bar member 5 comprises an upper and a lower longitudinal section 14 which extend parallel, preferably slightly curved, to the longitudinal center axis 15 of the guide bar member 5. The longitudinal sections 14 are connected at their free end by a reversing section 24 via which the saw chain 4 runs from one longitudinal section 14 to the other longitudinal section 14. Within the reversing section 24 a reversing wheel may be provided for guiding the saw chain. In the shown embodiment the reversing section 24 is a reversing slide guide for the saw chain.

For achieving a sufficient chain tension the guide bar 5 is adjustable in the longitudinal direction. The clamping force that is provided is essentially transmitted onto the saw chain 4 in the area of the reversing section 24. The reversing section 24 is thus subjected to increased wear.

The guide bar member 5 is preferably made of steel. It may be a one part member manufactured from a unitary base body or may be manufactured in sandwich construction from a plurality of parts layered one atop the other. For protecting the highly loaded reversing section 24 wear protectors 30 are arranged which are made of a material that is more wear-resistant than steel. In the shown embodiment the wear protectors 30 are components separate from the base body of the guide bar member 5 which wear protectors are connected to the end sections 23 of the stays 22 of the guide groove 20. Preferably, the wear protectors 30 are welded to the stays 22. FIG. 2 shows a corresponding welding seam 19. The wear protectors 30 may be connected to the stays by oxyacetylene welding or by welding with laser beams or, in the alternative, may be connected by brazing, if suitable materials are used.

The wear protectors 30, as shown in FIG. 2, have a width V perpendicular to the plane of the guide bar member 5 which is identical to the width S of the stay 22. The height H of the wear protector 30 is approximately ⅓ of the height of the stay 22. The height H of the wear protector 30, as is shown in the side view of FIG. 13 through 16, can vary over the length of the wear protector. Preferably, the height H is reduced over the length of the wear protector 30 toward the longitudinal center axis 15 of the guide bar member 5. The then reached height H1 may be approximately twice as great as the initial height H. At the exit section of the wear protector 30 the maximum height H1 is again reduced to the initial height H upon transition into the longitudinal section 14.

The more wear-resistant material of the wear protector 30 is relatively ductile. The preferred material is a cobalt hard alloy (stellite), which has been proven to be well suited for wear protector applications.

The wear protector 30 is, as shown in FIG. 2, provided with a bevel preferably at the inner longitudinal edge 31 which is facing the saw chain 4 so that a recess 40 is provided. This recess 40 extend in the longitudinal direction of the wear protector, preferably over its entire length. The wear protector 30, as schematically shown in FIG. 1, can extend partially along the longitudinal section 14 of the guide bar. The recess 40 extends advantageously at least over the radius R of the reversing section 24 (FIG. 1), especially also along the exit section 39 of the reversing section 24. When upon an extended operating time, due to the ductile properties of the material of the wear protector 30, material deformation occurs, the recess 40 will provide a free space into which the material can grow. This ensures that material deformations that occur will not enter the guide groove 20 where they would result in jamming of the drive members 7. It is also ensured that these material deformations will not cause unevenness of the race 25 which is provided at the end faces 37 of the wear protector 30.

The design and position of the recesses extending over at least a portion of the length of the wear protector, especially over the entire length, as shown in FIGS. 3 through 12, can vary greatly. The recess can be provided by beveling, respectively, rounding the longitudinal edge 31 adjacent to the guide groove or also of the longitudinal edge 32 facing away from the guide groove. The recess thus is provided within two of the exterior sides of the wear protector 30. The term "exterior side" includes the inner wear surface 35 which is part of the guide groove 20 as well as the lateral side 36 facing away from the guide groove 20 and also the end face wear surface 37 which forms the race 25 of the wear protector 30.

Figure 3:
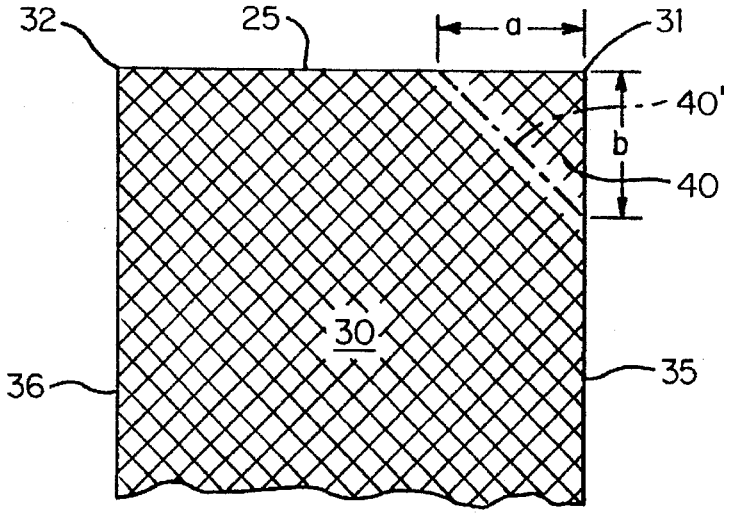
FIG. 3 is a sectional view of the wear protector connected to one stay of the guide groove with beveled longitudinal edge.

In FIG. 3 the recess 40 is provided at the inner longitudinal edge 31 whereby its width a in the plane of the race 25 is identical to the depth b measured in the in the plane of the wear surface (inner sidewall portion) 35 of the recess 40. In cross-section the recess 40 is thus of a triangular shape and extends over the entire length of the wear protector 30. The triangular shape is preferably that of an isosceles triangle. However, other triangular designs may also be expedient. In FIG. 2 the recess 40 is provided at the inner longitudinal edge 31 as well as the outer longitudinal edge 32. In each one of the exterior sides 35, 36, 37 a recess 40 is thus provided. The width a of the recess is expediently 0.05 to 1 mm, preferably 0.2 mm, the depth b is preferably 0.05 to 4 mm. The thus formed flattened portion 40' is preferably positioned at an angle of approximately 20° to the lateral surface 35.

Figure 4:
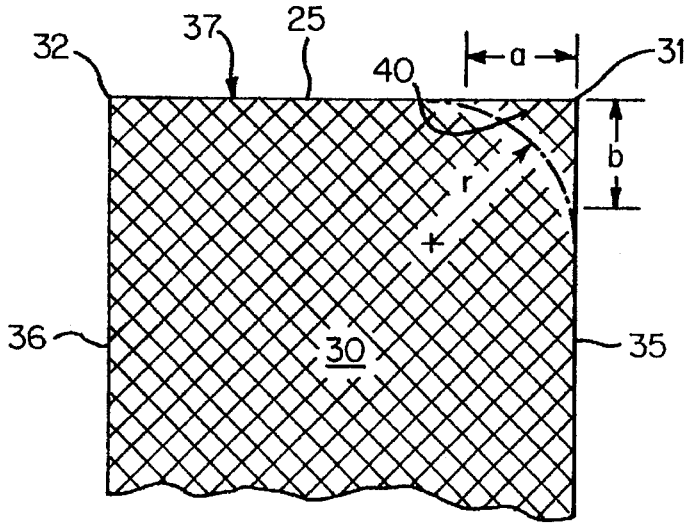
FIG. 4 is a sectional view of the wear protector connected to the stay of the guide groove with a convexly rounded longitudinal edge.
Figure 5:
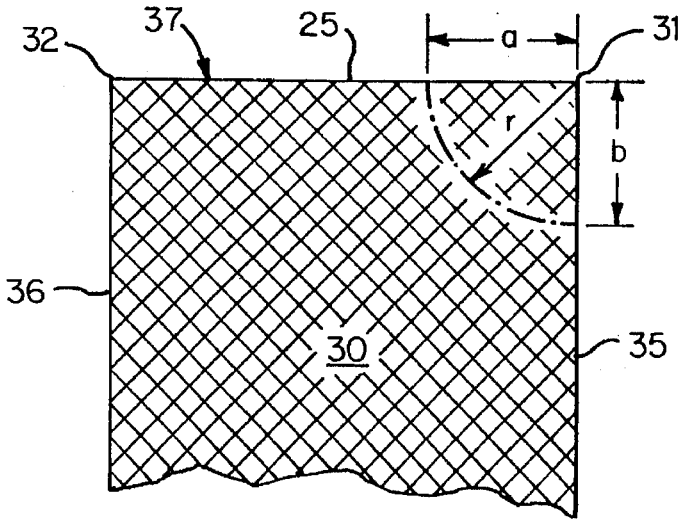
FIG. 5 is a sectional view of the wear protector connected to one of the stays of the guide groove with concavely rounded longitudinal edge.

In the embodiment according to FIG. 4 the inner longitudinal edge 31 is convexly rounded with a constant radius r. This results in a recess 40 having a width a and a depth b that are identical to one another. In the embodiment according to FIG. 5 the inner longitudinal edge 31 is concavely rounded whereby the width a and the depth b are identical to the radius r. The radius r is preferably 0.05 to 1.0 mm.

Figure 6:
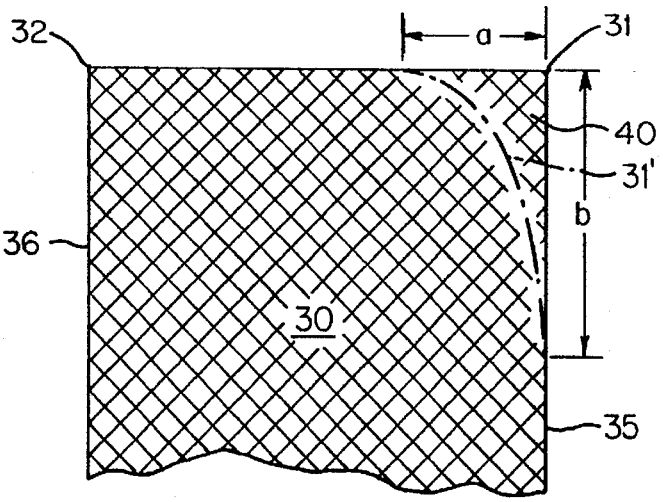
FIG. 6 is a sectional view of the wear protector connected to one of the stays of the guide groove with a convex longitudinal edge rounded according to a logarithmic function.
Figure 7:
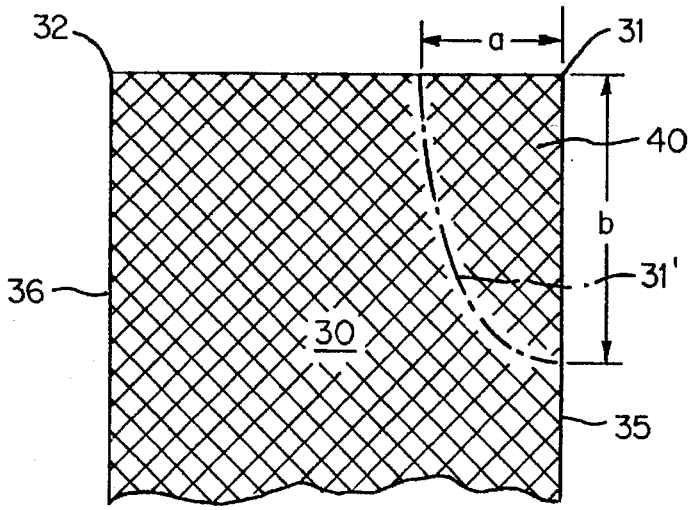
FIG. 7 is a sectional view of a wear protector connected to one of the stays of the guide groove with concavely shaped longitudinal edge rounded according to a logarithmic function.

In the embodiment according to FIG. 6 the inner longitudinal edge 31 is rounded according to a logarithmic function. The rounded edge 31' corresponds to a parabola which is convexly curved. The width a of the recess 40 is thus smaller then the depth b. A similar ratio of width a to depth b is shown in FIG. 7 for a rounded edge according to a logarithmic function which represents a parabola branch. By machining the inner longitudinal edge 31 a concavely rounded longitudinal edge 31' results so that the recess 40 is accordingly shaped. In FIGS. 6 and 7 the width a of the recess 40 is approximately 0.05 to 1 mm, the depth b of the recess 40 is preferably 0.1 to 4.0 mm.

The machining of the longitudinal edge 31, respectively, 32 can be preformed by milling, stamping or cutting. However, the longitudinal edge is preferably deformed to the desired shape, for example, by swaging or forging.

It has been shown that especially in the area of the stamped, swaged or forged bevel the material of the wear protector 30 will become harder. It has been found, for example, that for an initial hardness of the wear protector of 400 HV (Vickers) a hardness increase in the area of the formed bevel results. In the first range i an increase to 450 HV, in the second area ii an increase to 550 HV, and in the area iii, limiting the bevel, an increase of hardness to 650 HV could be detected. This means that by material machining, respectively, deforming for providing the recess 40 a material hardening effect of up to 60 percent can be achieved at the same time so that wear can be substantially reduced.

Figure 8:
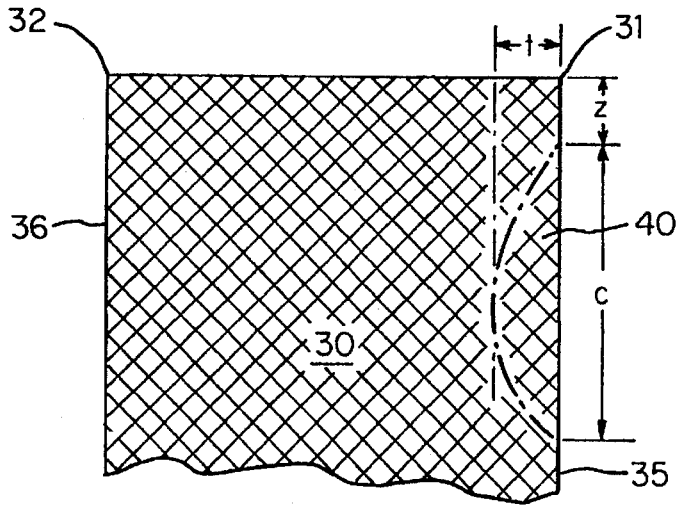
FIG. 8 is a sectional view of the wear protector connected to the stay of the guide groove with a recess within the wear surface facing the guide groove.

In the embodiment according to FIG. 8 a recess 40 extending in the longitudinal direction of the wear protector 30 is provided, preferably at the inner lateral surface 35. In cross-section this recess is as a circular section. The edge length c of the circular section is multiple times greater than the depth t. The circular segment 40 is positioned at a distance c to the preferably unmachined longitudinal edge 31 whereby the distance c is approximately identical to depth t. Preferably, the recess 40 is positioned approximately centrally within the wear surface 35 and extends over approximately two thirds of the height of the lateral surface 35.

Figure 9:
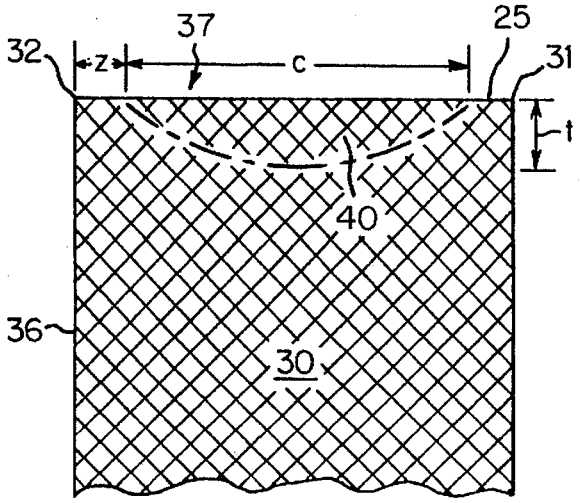
FIG. 9 is a sectional view of the wear protector connected to one of the stays of the guide groove with a recess having the shape of a circular section at the wear surface providing the race for the saw chain.

In the embodiment according to FIG. 9 a recess 40 is provided within the race 25 which recess corresponds substantially in its shape to the recess of FIG. 8. The inner as well as the outer longitudinal edge 31, 32 of the wear protector 30 are preferably not machined or only slightly beveled. The recess 40 extends in the peripheral direction of the wear protector 30 preferably over its entire length.

Figure 10:
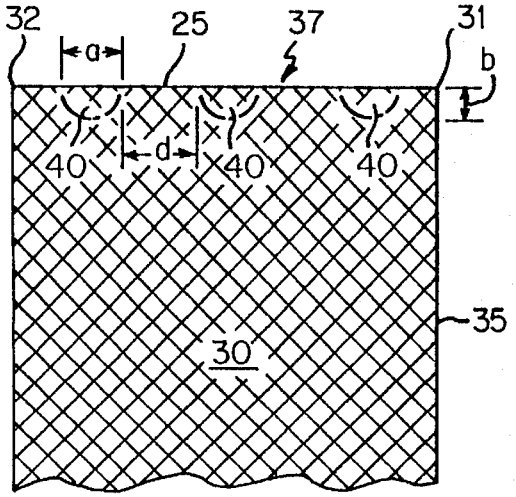
FIG. 10 show a sectional view of the wear protector connected to one of the stays of the guide groove according to FIG. 9 with the plurality of circular section-shaped recesses.

In the embodiment according to FIG. 10 over the width of the wear surface 37, forming the race 25, a plurality of recesses 40 are provided which have a width a and a depth b. The width a and the depth b are approximately identical so that the recesses 40 extending over the length of the wear protector 30 have a approximately circular cross-section. Preferably, the recesses 40 extend in the peripheral direction of the wear protector 30 parallel to one another at a distance d, whereby the distance d between the recesses 40 is preferably identical. It may be expedient that the recesses are positioned directly adjacent to one another (see for example FIG. 12).

Figure 11:
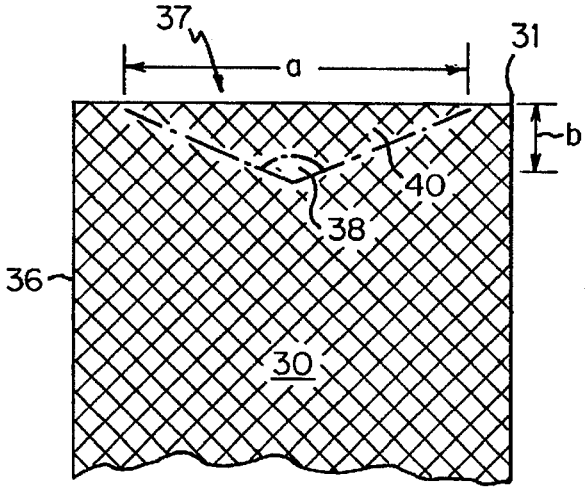
FIG. 11 shows a sectional view of the wear protector connected to one of the stays of the guide groove with a recess of a triangular cross-sectional shape provided at the wear surface forming the race for the saw chain.

The embodiment according to FIG. 11 corresponds essentially to the design of FIG. 9. The recess 40 of the wear protector 30 of FIG. 11 in cross-section is triangular whereby the surfaces extending into the wear protector are positioned at an angle 38 relative to one another which is greater than 90½. The width a of the recess 40 is preferably multiple times greater than the depth b.

Figure 12:
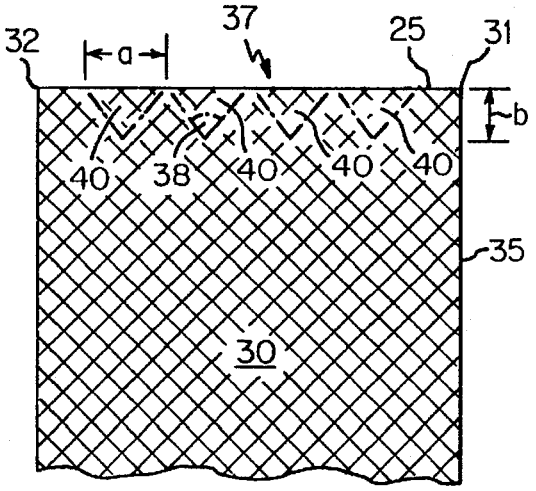
FIG. 12 shows a sectional view of a wear protector connected to one of the stays of the guide groove according to FIG. 11 with the plurality of adjacently arranged recesses.

In the embodiment according to FIG. 12 a plurality of adjacently arranged recesses 40 is provided which laterally abut one another. Each recess 40 has a triangular cross-section whereby the surfaces extending into the wear protector have an angle 38 of less than 90½ relative to one another. Preferably, the width a of each recess 40 is only slightly greater than the depth b. The recesses 40 extend in the peripheral direction of the wear protector 30 parallel to one another. The recesses 40 preferably also extend substantially parallel to the longitudinal edges 31, 32.

Figure 13:
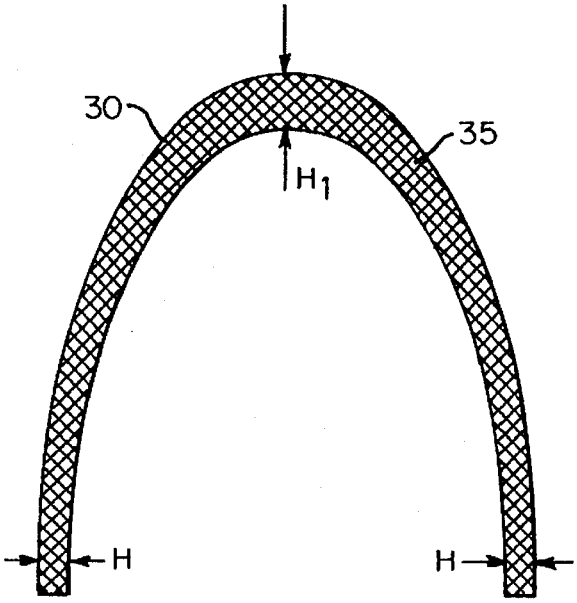
FIGS. 13–16 show side views of wear protectors with wear surfaces of different surface finishes.
Figure 14:
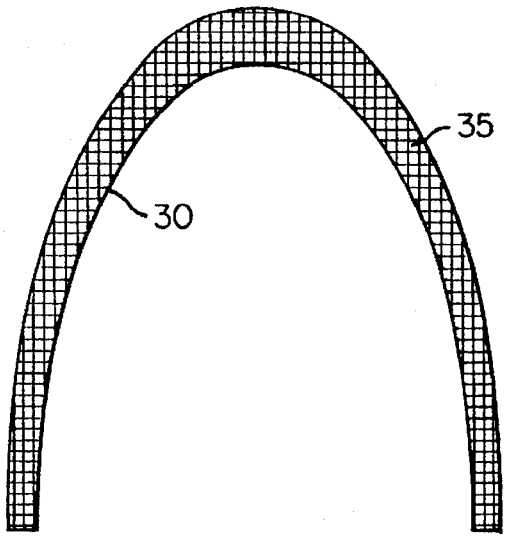
Figure 15:
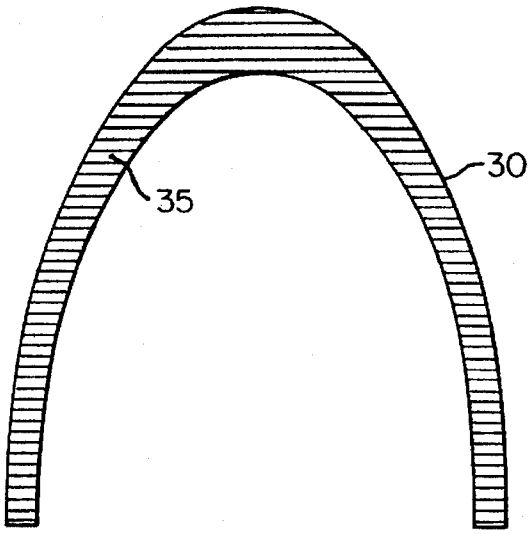
Figure 16:
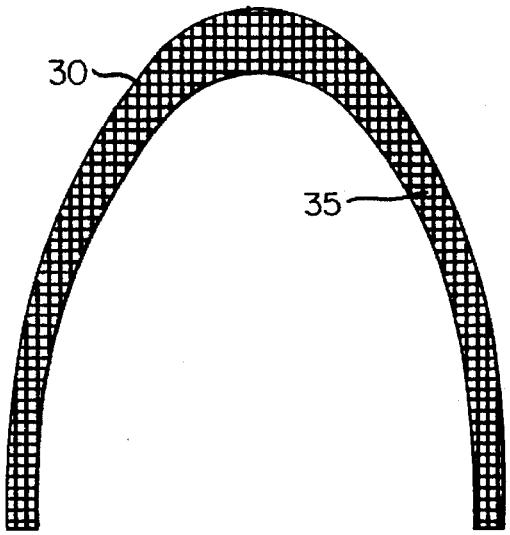

It may be advantageous to provide the exterior sides of the wear protector 30 with a rough surface finish, especially those exterior sides that are part of the guide groove 20. The wear surface 35 therefore can be provided with crossed serrations as shown in FIG. 13 or may be provided with longitudinal or transverse serrations as shown in FIG. 15. FIG. 14 shows the inner wear surface 35 with a fine grain structure while in FIG. 16 the inner lateral surface 35 has a coarse grain structure. By designing especially the inner wear surface 35 of the wear protector 30 according to the embodiments of FIGS. 13 to 16, the residence time of the oil introduced into the guide groove is increased so that especially at the greatly loaded reversing section a greater amount of oil is provided for lubricating purposes.

The present invention is, of course, in no way restricted to the specific disclosure of the specification and drawings, but also encompasses any modifications within the scope of the appended claims.

What we claim is:

1. A guide bar for a motor chain saw, said guide bar comprising:

a guide bar member having a peripheral guide groove and peripheral shoulders for guiding a saw chain in a peripheral direction of said guide bar member, wherein drive members of the saw chain engage said guide groove and wherein lateral connecting members of the saw chain are guided on said shoulders;

wear protectors comprised of a material that is more wear-resistant than said guide bar member, said wear protectors connected to said shoulders so as to extend at least over a portion of said guide bar member in said peripheral direction;

each one of said wear protectors having a first wear surface facing the drive members of the saw chain and a second wear surface facing the lateral connecting members of the saw chain; and wherein at least one of said first and second wear surfaces of each one of said wear protectors has at least one peripheral recess extending in said peripheral direction.

2. A guide bar according to claim 1, wherein said at least one peripheral recess extends over the entire length of said wear protectors.

3. A guide bar according to claim 1, wherein across the width of one of said first and second wear surfaces of each one of said wear protectors a plurality of said peripheral recesses is arranged adjacent to one another.

4. A guide bar according to claim 3, wherein neighboring ones of said peripheral recesses laterally abut one another.

5. A guide bar according to claim 3, wherein neighboring ones of said peripheral recesses are spaced at a distance from one another.

6. A guide bar according to claim 5, wherein said peripheral recesses are spaced equidistantly from one another.

7. A guide bar according to claim 1, wherein said at least one peripheral recess extends parallel to a longitudinal edge of said wear protectors.

8. A guide bar according to claim 1, wherein said peripheral recesses in cross-section have a contour of a circular sector.

9. A guide bar according to claim 1, wherein said peripheral recesses in cross-section have an angular contour.

10. A guide bar according to claim 9, wherein said contour is triangular.

11. A guide bar according to claim 1, wherein said peripheral recess has a maximum depth and a width.

12. A guide bar according to claim 11, wherein said maximum depth is identical to said width.

13. A guide bar according to claim 11, wherein said width is greater than said maximum depth.

14. A guide bar according to claim 1, wherein said peripheral recess is positioned centrally within said wear surface.

15. A guide bar according to claim 1, wherein said peripheral recess is located in said first wear surface.

16. A guide bar according to claim 1, wherein said peripheral recess is located in said second wear surface.

17. A guide bar according to claim 1, wherein said second wear surface has two longitudinal edges.

18. A cutter bar according to claim 17, wherein at least one of said longitudinal edges is selected from the group consisting of a swaged longitudinal edge, a cut longitudinal edge, a stamped longitudinal edge, and a forged longitudinal edge.

19. A guide bar according to claim 17, wherein at least one of said longitudinal edges is convexly rounded.

20. A guide bar according to claim 19, wherein said longitudinal edge is rounded with a constant radius.

21. A guide bar according to claim 19, wherein said longitudinal edge has a curvature determined by a logarithmic function.

22. A guide bar according to claim 17, wherein at least one of said longitudinal edges is concavely rounded.

23. A guide bar according to claim 22, wherein said longitudinal edge is rounded with a constant radius.

24. A guide bar according to claim 22, wherein said longitudinal edge has a curvature determined by a logarithmic function.

25. A guide bar according to claim 17, wherein at least one of said longitudinal edges has a bevel.

26. A guide bar according to claim 25, wherein said bevel extends over a portion of the width of said first wear surface and over a portion of the width of said second wear surface, wherein said portion of the width of said first wear surface is greater than said portion of the width of said second wear surface.

27. A guide bar according to claim 1, wherein said wear protectors and said guide bar member are separate parts and wherein said wear protectors are fastened to said peripheral shoulders.

28. A guide bar according to claim 1, wherein said first wear surface of said wear protectors has a rough surface finish.

29. A guide bar according to claim 28, wherein said rough surface finish has a corrugated or fluted structure.

30. A guide bar according to claim 28, wherein said rough surface finish is comprised of a grainy structure.

* * * * *